US008171586B2

(12) United States Patent
Clack

(10) Patent No.: US 8,171,586 B2
(45) Date of Patent: May 8, 2012

(54) BEDSIDE STORAGE SYSTEM

(76) Inventor: Robbie Clack, Brandon, MS (US)

( * ) Notice: Subject to any disclaimer, the term of this patent is extended or adjusted under 35 U.S.C. 154(b) by 71 days.

(21) Appl. No.: 12/782,072

(22) Filed: May 18, 2010

(65) Prior Publication Data

US 2011/0179574 A1 Jul. 28, 2011

Related U.S. Application Data

(60) Provisional application No. 61/299,027, filed on Jan. 28, 2010.

(51) Int. Cl.
*A47G 9/02* (2006.01)

(52) U.S. Cl. ..... 5/658; 5/503.1; 5/485; 5/490; D6/601; 297/188.2

(58) Field of Classification Search ..... 5/639, 640, 5/645, 658, 503.1, 485, 490–492, 419; D6/601; 297/188.2
See application file for complete search history.

(56) References Cited

U.S. PATENT DOCUMENTS

D360,795 S * 8/1995 Saunders ..... D6/601
5,581,829 A * 12/1996 Lee ..... 5/503.1
5,758,972 A * 6/1998 Mack et al. ..... 5/503.1
6,594,836 B1 * 7/2003 Everson et al. ..... 5/485
6,601,250 B1 * 8/2003 Taylor ..... 5/485
6,848,132 B1 * 2/2005 Dale ..... 5/503.1
6,854,139 B2 * 2/2005 Lamy ..... 5/485
7,526,822 B2 * 5/2009 Joyce ..... 5/485
2008/0178386 A1 * 7/2008 Thompson ..... 5/485
2010/0122413 A1 * 5/2010 McNair ..... 5/485

* cited by examiner

*Primary Examiner* — Michael Trettel

(74) *Attorney, Agent, or Firm* — Patent Service Associates; Lyman H. Smith

(57) ABSTRACT

A storage system stores and easily locates common items, such as reading glasses, remote controls, cell phones, magazines, books, and the like, while a person is in a room or in bed. In an emergency, a person may be able to easily locate these items. The storage system may replace a cluttered nightstand and may provide immediate location of necessary items. The storage system may include a pillow that may span a length of a bed, along the head end of a mattress. The pillow may prevent people, such as children or infants, and items from falling between the head of the mattress and either the wall or headboard. The pillow may also provide an elevated surface to prop up a user's pillow for reading or watching television.

10 Claims, 2 Drawing Sheets

BEDSIDE STORAGE SYSTEM

CROSS-REFERENCE TO RELATED APPLICATIONS

This application claims the benefit of priority of U.S. Provisional patent application No. 61/299,027, filed Jan. 28, 2010, herein incorporated by reference.

BACKGROUND OF THE INVENTION

The present invention relates to bedside storage and, more particularly, to a pillow pack that may span across a bed with pouches on each side for storage of items.

It is often difficult to keep or centralize in one location in a room items such as a cell phone, remote control, eyeglasses and the like. If the electricity goes out, or in an emergency, it may be hard to find an alternative light source such as a flashlight or cell phone.

As can be seen, there is a need for a storage system for organizing and storing items in a location with easy access, especially for a person in a bed.

SUMMARY OF THE INVENTION

In one aspect of the present invention, a storage system comprises a bed panel adapted to span a width of a bed; at least one side panel attached to at least one end of the bed panel; a plurality of pouches in the side panel; and a pillow attached to one edge of the bed panel.

In another aspect of the present invention, a pillow pack storage system comprises a bed panel adapted to span a width of a bed; first and second side panels attached to first and second ends of the bed panel; a plurality of pouches in the side panel; and an elongated pillow attached along an entire length of one edge of the bed panel.

These and other features, aspects and advantages of the present invention will become better understood with reference to the following drawings, description and claims.

DETAILED DESCRIPTION OF THE INVENTION

Figure 1:
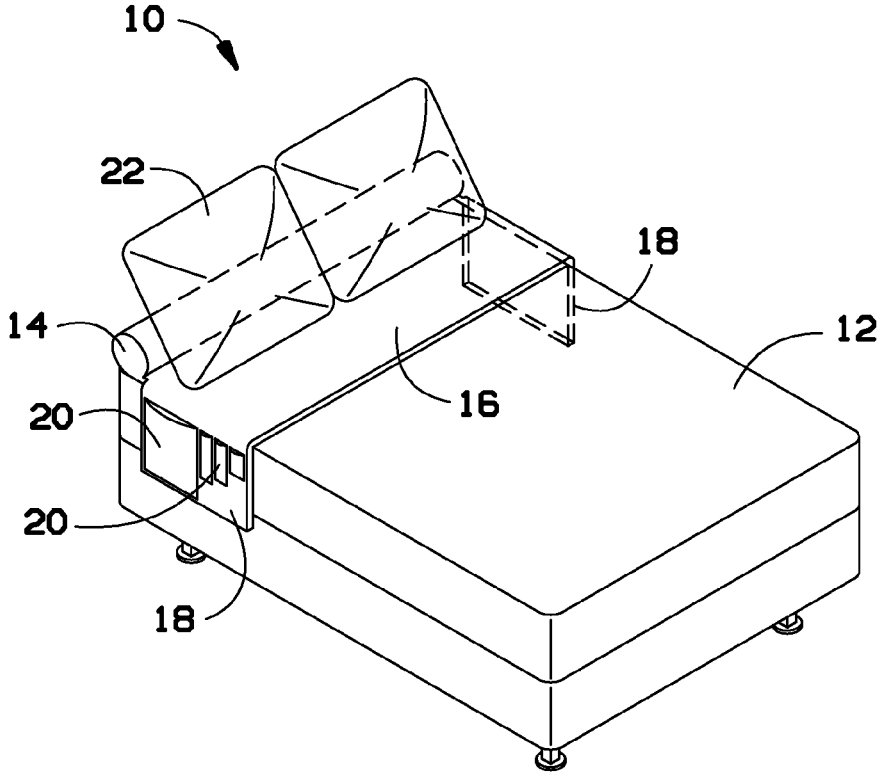
FIG. 1 is a perspective view of a pillow pack storage system according to an embodiment of the present invention.
Figure 2:
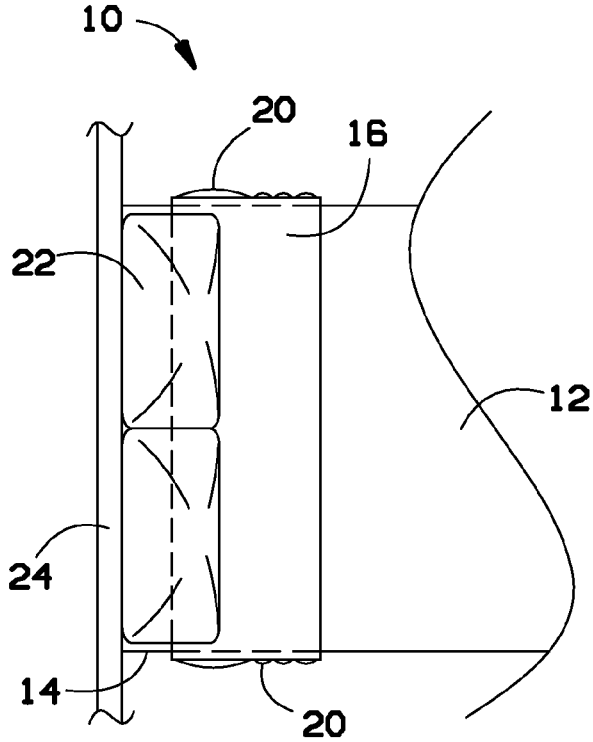
FIG. 2 is a plan view of the pillow pack storage system of FIG. 1.
Figure 3:
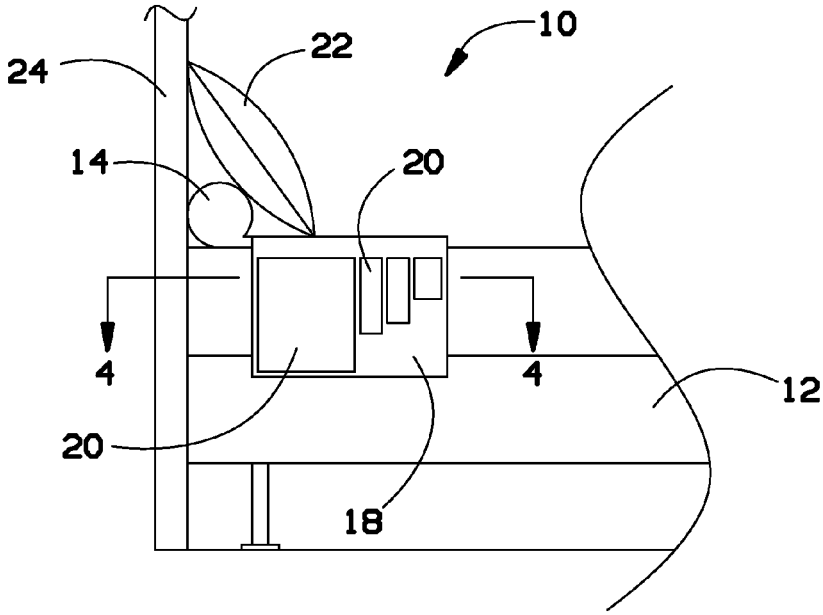
FIG. 3 is a side view of the pillow pack storage system of FIG. 1.
Figure 4:
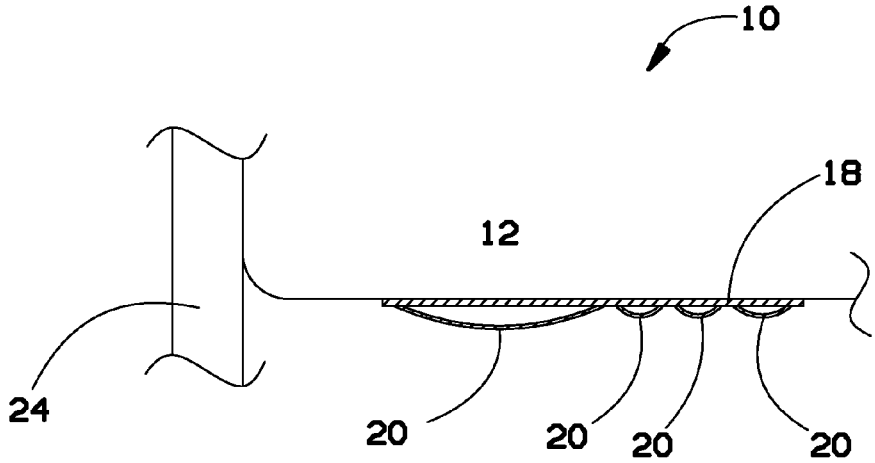
FIG. 4 is a partial cross-sectional view taken along line 4-4 of FIG. 3.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Various inventive features are described below that can each be used independently of one another or in combination with other features.

Broadly, an embodiment of the present invention provides a storage system for storing and easily locating common items, such as reading glasses, remote controls, cell phones, magazines, books, and the like, while a person is in a room or in bed. In an emergency, a person may be able to easily locate these items. The storage system of the present invention may replace a cluttered nightstand and may provide immediate location of necessary items. The storage system, according to an embodiment of the present invention, may include a pillow that may span a length of a bed, along the head end of a mattress. The pillow may prevent people, such as children or infants, and items from falling between the head of the mattress and either the wall or headboard.

Referring to FIGS. 1 through 4, a pillow pack storage system 10 may include an elongated pillow 14 attached to a bed panel 16. The pillow 14 may have a circular cross section. The pillow 14 may rest at the head of a mattress 12, for example, at a corner formed between the mattress 12 and a wall or headboard 24. The bed panel 16 may fit widthwise across the mattress 12.

At least one side panel 18 may be attached to at least one end of the bed panel 16. In one embodiment of the present invention, one side panel 18 may be attached to each end of the bed panel 16, as shown in FIG. 1. The side panel 18 may include a plurality of pouches 20. The pouches 20 may be made of different sizes to accommodate items of various sizes. For example, a small pouch 20 may be made to contain a cell phone, wherein a larger pouch 20 may be sized to hold the Bible or other reading material.

The bed panel 16 may be sized to span across the mattress 12 so that the side panels 18 may hang vertically along the sides of the mattress 12. In one embodiment, for example, for a king-sized bed, the bed panel 16 may be about 110 inches long and from about 12 to 24 inches, typically about 18 inches, wide. The side panels 18 may be the approximately the same width of the bed panel 16 and may extend from about 10 to 14 inches, typically about 12 inches, from the bed panel 16. The bed panel 16 may be made of a soft material, similar to a bed sheet. The bed panel 16 may be sized to fit standard bed widths, such as twin size, full size, queen, king and the like. The bed panel 16 may also be custom made to fit other sleeping surfaces, such as recreational vehicle beds, cots, portable camping sleeping cots, hide-a-beds, and the like. The length of the side panels 18 may be shortened for sleeping surfaces that may lie close to the ground.

The pouches 20 may be sewn into the side panels 18. Alternatively, the pouches 20 may be removably attached to the side panels 18 with, for example, a hook and loop-type fastener, such as Velcro®. The pouches 20 may be individually purchased by a user to suit their needs. The pouches 20 may be in various sized, such as 9 inch, 4 inch, 2.5 inch and 2 inch.

The pillow 14 may provide a safety feature by blocking a space that may exist between the mattress 12 and the wall or headboard 24. Items, children or infants may fall into this space when pillow pack storage system 10 is not installed on the mattress 12. The pillow 14 may also provide an additional cushion for a person's head against the headboard 24. The pillow 14 may also provide an elevated surface to prop up a pillow 22 while reading or watching television.

It should be understood, of course, that the foregoing relates to exemplary embodiments of the invention and that modifications may be made without departing from the spirit and scope of the invention as set forth in the following claims.

What is claimed is:

1. A storage system comprising:

a bed panel adapted to span a width of a bed, the bed panel having a width between 12 and 24 inches;

at least one side panel attached to and freely extending from at least one end of the bed panel, the side panel having a length, extending from the bed panel, between 10 and 14 inches;

a plurality of pouches in the side panel; and a pillow attached to one edge of the bed panel.

2. The storage system of claim 1, further comprising first and second side panels attached to first and second ends of the bed panel.

3. The storage system of claim 1, wherein the pillow is an elongated pillow having a circular cross-section.

4. The storage system of claim 3, wherein the elongated pillow is attached along an entire length of one edge of the bed panel.

5. The storage system of claim 1, wherein the pouches have various sizes and shapes.

6. The storage system of claim 1, wherein the pouches are removably attached to the side panel.

7. The storage system of claim 1, wherein the side panels are configured to be disposed vertically along a side of a mattress when the storage system is installed on a mattress.

8. The storage system of claim 1, wherein the pillow is adapted to cover a space between a mattress and a headboard or a wall adjacent to the mattress.

9. A pillow pack storage system comprising:

a bed panel adapted to span a width of a bed, the bed panel having a width between 12 and 24 inches;

first and second side panels freely extending from and attached to first and second ends of the bed panel;

a plurality of pouches in the side panel; and an elongated pillow attached along an entire length of one edge of the bed panel.

10. The pillow pack storage system of claim 9, wherein the pouches have various shapes and sizes to store various size items.

* * * * *